US007699960B2

(12) United States Patent
Ono et al.

(10) Patent No.: US 7,699,960 B2
(45) Date of Patent: Apr. 20, 2010

(54) PROCESSES AND APPARATUS FOR PRODUCING CAST COATED PAPERS

(75) Inventors: Katsumasa Ono, Tokyo (JP); Hidenobu Todoroki, Tokyo (JP); Yuji Abe, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 607 days.

(21) Appl. No.: 10/551,180

(22) PCT Filed: Mar. 31, 2004

(86) PCT No.: PCT/JP2004/004689

§ 371 (c)(1),
(2), (4) Date: Sep. 29, 2005

(87) PCT Pub. No.: WO2004/088038

PCT Pub. Date: Oct. 14, 2004

(65) Prior Publication Data

US 2006/0254735 A1 Nov. 16, 2006

(30) Foreign Application Priority Data

Mar. 31, 2003 (JP) ..... 2003-097433

(51) Int. Cl.
*D21F 11/00* (2006.01)
*D21H 25/06* (2006.01)

(52) U.S. Cl. ..... 162/265; 162/112; 162/119; 162/135; 162/136; 427/331; 427/348; 427/398.1; 427/398.4; 427/395

(58) Field of Classification Search ..... 162/136, 162/112, 119, 265; 427/331, 335, 377, 378, 427/382, 395, 398.4
See application file for complete search history.

(56) References Cited

U.S. PATENT DOCUMENTS 2,367,503 A * 1/1945 Tanner et al. ..... 106/170.53
2,560,039 A * 7/1951 Harlow, Jr. ..... 26/104

(Continued)

FOREIGN PATENT DOCUMENTS

EP 0 770 729 A1 5/1997

(Continued)

OTHER PUBLICATIONS

Smook, Handbook for Pulp and Paper Technologists, 1992, Angus Wilde Publications, 2nd edition, p. 286-292, 345-346.*

(Continued)

*Primary Examiner*—Eric Hug
*Assistant Examiner*—Anthony J Calandra
(74) *Attorney, Agent, or Firm*—Nixon & Vanderhye P.C.

(57) ABSTRACT

Methods for producing cast-coated papers showing a reduced level of curling and reduced curling or wavy deformation caused by moisture absorption or other reasons as well as showing a high surface quality in the cast-coated surface. The steps for producing cast-coated papers include applying a coating color based on a pigment and an adhesive on one side of a base paper, and pressing/drying the coated layer in the wet state against a casting drum mirror surface, where moisture is added to the coated paper by passing it through conditioned air at a high temperature and a high humidity (for 20 seconds or more) after pressing/drying the coated layer against a casting drum.

6 Claims, 1 Drawing Sheet

U.S. PATENT DOCUMENTS

| | | | | |
|---|---|---|---|---|
| 3,191,312 | A * | 6/1965 | Allander | 34/392 |
| 4,853,255 | A * | 8/1989 | Onishi et al. | 427/148 |
| 5,009,016 | A * | 4/1991 | LePisto et al. | 34/421 |
| 5,755,929 | A | 5/1998 | Kuroyama et al. | |
| 2003/0057595 | A1* | 3/2003 | Tsujimoto | 264/217 |

FOREIGN PATENT DOCUMENTS

| | | |
|---|---|---|
| JP | 59-59995 | 4/1984 |
| JP | 60-94692 | 5/1985 |
| JP | 62-133198 | 6/1987 |
| JP | 6-227113 | 8/1994 |
| JP | 9-11607 | 1/1997 |
| JP | 9-263040 | 10/1997 |
| JP | 11-348416 | 12/1999 |
| JP | 2003-293289 | 10/2003 |
| SU | 1618803 A * | 1/1991 |

OTHER PUBLICATIONS

English Derwent Summary of SU-1618803A.*
English Derwent Summary of SU-1618803A, 2008.*
International Search Report for PCT/JP2004/004689 dated Jun. 29, 2004.

* cited by examiner 1. casting drum
2. coater head (coating section)
3. gelling solution applicator
4. reverse face water applicator
5. cylinder dryer
6. air nozzle
7. conditioned chamber
8. blower
9. expander roll

PROCESSES AND APPARATUS FOR PRODUCING CAST COATED PAPERS

This application is the US national phase of international application PCT/JP 2004/004689 filed 31 Mar. 2004, which designated the U.S. and claiming priority to JP 2003-97433 filed 31 Mar. 2003, the entire contents of each of which are hereby incorporated by reference.

BACKGROUND OF THE INVENTION

1. Field of the Invention

The present invention relates to processes and apparatuses for producing cast-coated papers, particularly to processes for producing cast-coated papers for ink jet recording, which can effectively prevent curling in a wide range of environments as well as curling during printing/recording.

2. Description of Related Art

Cast-coated papers are characterized by higher sheet gloss and better surface quality as compared with ordinary coated papers because the surface feature of the mirror surface of a casting drum is transferred onto the paper. Conventionally, cast-coated papers have been widely used for various purposes including commercial printing such as the covers of magazines and posters; bags such as high-quality shopping bags and fancy packing boxes; release papers for adhesive labels; ink jet recording for ink jet printing and the like. It has become especially possible recently to achieve very high quality full-color printing close to silver salt photographic printing using cast-coated papers for ink jet recording by improving the suitability of cast-coated papers for use in ink jet recording such as ink absorbency and image reproducibility.

Generally, processes for producing cast-coated papers are roughly classified into the following categories: the direct process involving applying a coating color onto the surface of a base paper and then immediately pressing the coated layer in the wet state against a casting drum with forming rolls; the gel cast coating process involving applying a coating color, then passing the coated layer through a gelling bath to convert it into a malleable gel state with plasticity and then pressing it against a casting drum; the re-wet cast coating process involving the application of a coating color to the paper and once drying, to give the paper a dry coated surface and then rewetting/plasticizing the coated surface with water or an appropriate rewetting solution and pressing it against a casting drum, etc.

All of the above-described processes provide a glazed finish by applying a coating color containing a pigment and an adhesive onto a base paper and pressing the coated layer side of the paper plasticized with water, against the surface of a heated casting drum having a mirror surface with forming rolls (press rolls), and drying and releasing the paper. In general, cast-coated papers show a great difference in the coating amounts used on the two sides of the paper and, therefore tend to be more liable to curling than ordinary coated papers when exposed to atmospheric changes and fluctuations in humidity. This is so especially with cast-coated papers provided with ink jet-printability as a coated layer which have a strong tendency to undergo curling when exposed to changes in humidity; presumably because of their good affinity to water.

When storing paper that has been cut into sheets for use in offset printing, it is necessary to keep the paper flat and pressed because offset printing paper which has been cut into sheets and stacked can absorb moisture from the surrounding atmosphere if the moisture content of the paper is low, and therefore, has a greater tendency to curl and warp when printing is performed on the cast-coated surface or the opposite surface.

Ink jet recording is a recording process of depositing small ink particles that are projected by various mechanisms onto a recording paper to form dots having the advantage of being readily adaptable to full-color printing and performing high-speed printing. However, the ink jet recording process has the disadvantage that a significant level of curling occurs after printing, depending on the kind of paper used, because of swelling (with the aqueous inks used in printing) and shrinking (by drying) of the fibers of the base paper. In an attempt to reduce this curling, the non-cast-coated surface of the printing paper was acted upon by water vapor to give 1.0 g of moisture per $m^2$ of paper (see JPA HEI 9-11607, pp. 3-9), but the product significantly curled in the direction of the non cast-coated surface. Moreover, the treatment with water vapor was found to be insufficient with regard to reducing waving and curling of the printing paper when exposed to environmental change.

BRIEF SUMMARY OF THE INVENTION

In view of the situation above, an object of the present invention is to provide a process for producing a cast-coated paper showing a reduced level of curling after the preparation of the cast-coated paper and a high surface quality in the cast-coated surface as well as showing no curling or wavy deformation due to moisture absorption or desorption, especially achieving the lowest possible level of curling during ink jet printing.

As a result of careful studies to achieve the object described above, we succeeded in obtaining a cast-coated paper having a high surface quality and with reduced curling occurring immediately after preparation, by a process of producing a cast-coated paper comprising the steps of applying a coating color based on a pigment and an adhesive on one side of a base paper, and pressing/drying the coated layer in the wet state against a mirror surface of a casting drum, wherein said process further comprises the step of hydrating the coated paper by maintaining it in a chamber controlled at a high temperature and a high humidity of 20-80° C., 50-95% RH after pressing/drying the coated layer against a casting drum and before reeling.

We also found that cast-coated papers having a high quality of coated surface and with reduced curling of the paper occurring immediately after preparation can be obtained, by using an apparatus for producing a cast-coated paper, as a means for practically carrying out the process described above, the apparatus comprising: (1) a coater head, for applying a coating color based on a pigment and an adhesive on one side of a base paper, (2) a casting drum, for pressing/drying the coated layer in the wet state against the mirror surface of the casting drum, and (3) a conditioned chamber, having an inlet and an outlet for a web of cast-coated paper in this order, wherein said chamber at the inlet side is connected to a blower for sending conditioned air into said chamber and has a conditioned air vent at the outlet, whereby said chamber is conditioned at 20° C.-80° C., 50-95% RH and said web is maintained in said chamber for 20 seconds or more. The web of cast-coated paper contains a large amount of moisture and the temperature of the web is very high immediately after pressing/drying the coated layer against a casting drum. Therefore, a device for lowering the temperature of the web is desirably provided within the apparatus immediately before the chamber as a higher hydration efficiency is obtained in the chamber if the temperature of the paper surface is lowered immediately before the web is transferred into the conditioned chamber rather than transferring the web when it is still hot.

The temperature of the web can be lowered by bringing it into contact with the surface of a metal roll incorporating a cooling device, cooling water, blowing of cold air, or other methods.

The device for lowering the temperature of the web is also desirably provided immediately after the chamber because the moisture deposited on the web is otherwise readily removed at the web temperature approximately equal to the temperature within the chamber and the web is liable to curl if it is reeled when still hot. In addition, a gelling solution applicator can be provided after the coater head and before the casting drum; a water applicator, for applying water onto the opposite surface of the coated surface can be provided after the casting drum and before the conditioned chamber; and air nozzles, for blowing air onto the surface of the web in the chamber can be provided. It should be noted that the web can be repeatedly run along a loop in the chamber so that the web can be maintained within the chamber for 20 seconds or more. Especially if the temperature and humidity within the chamber are set at high levels, the paper rapidly absorbs moisture, and as a result, rapidly stretches in the direction orthogonal to the running direction. If the running direction of the paper is changed using normal paper rolls when the web is run along a loop in order to maintain the web within the chamber for 20 seconds or more, any excess amount of paper cannot be absorbed and wrinkles often occur on the rolls. Thus, it is desirable to use an expander roll having the effect of laterally stretching paper at an early stage of the web running in the chamber.

Normally, cast-coated papers after pressing/drying the coated layer against a casting drum have a moisture content as low as 1.5-4% and they are liable to problems of shape distortion such as curling or wavy wrinkling because of absorbing moisture when they are cut into sheets after preparation, but these problems can be avoided by preparing a product having a high moisture content of 5% or more.

It was also found that the hydration efficiency of paper can be increased without impairing the surface quality of the cast-coated surface by blowing air approximately at the same temperature and humidity as that within the chamber onto the cast-coated surface and the opposite surface during the passage of the web through the chamber at high temperature and humidity and the level and shape of curling can be strictly controlled by adjusting the flow rate of the air on both, the cast-coated surface and the opposite surface.

In order to further reduce curling of paper when the environmental humidity is changed or after offset printing and ink jet printing have been performed, it proved desirable to apply water or an aqueous solution or an aqueous dispersion of a pigment or the like onto the opposite surface to the cast-coated surface of the paper, immediately after pressing/drying the coated layer against a casting drum for drying and then adding moisture to the coated paper in a chamber controlled at a high temperature and a high humidity by applying water onto the opposite surface to the cast-coated surface and-drying the paper.

The reason why reduced curling is achieved by hydrating the cast-coated paper according to the present invention is explained as follows. As described in the present invention, by the process of hydrating, curling and wavy deformation of paper can be reduced because the amount of moisture absorbed upon exposure to the outside air decreases as a result of the increase in the moisture content of the cast-coated paper, and curling of paper during laying flat after being cut into sheets can also be reduced because the flexural rigidity of the cast-coated paper decreases with the increase in moisture content.

The reason why curling caused by changes in environmental humidity is reduced by applying an aqueous dispersion onto the opposite surface and drying it is explained as follows. When water or an aqueous solution or an aqueous dispersion of a pigment or the like is applied onto the opposite surface to the cast surface formed after pressing/drying the coated layer against the casting drum and dried again, the opposite surface to the cast surface stretches and then moderately shrinks and the fibers close to the cast surface release the shrinkage stress accumulated during drying at the casting drum, thereby preventing curling.

DETAILED DESCRIPTION OF THE INVENTION

Figure 1:
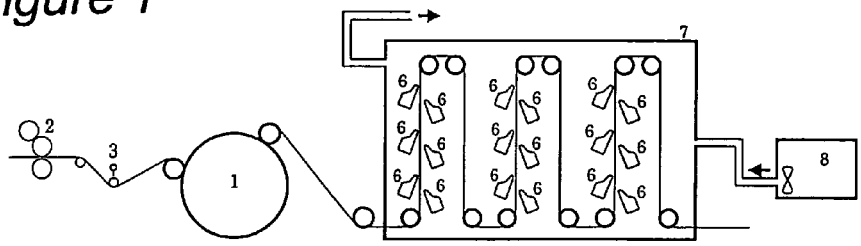
FIG. 1 is a schematic view of an example of a manufacturing apparatus of the present invention.

Base papers for cast-coated papers of the present invention can be obtained for e.g., by disintegrating pulp fibers into a slurry and passing the slurry through a paper machine optionally with a filler and a sizing agent and other additives, and then drying the web or treating the web with an aqueous solution of a starch or a polymer material or the like in a size press and drying and subjecting it to machine calendaring. Suitable pulps can be appropriately selected from those used in ordinary paper making such as chemical pulps derived from L (hardwood) and N (softwood) materials, mechanical pulps and recycled pulps; and suitable fillers can be appropriately selected from those commonly used such as talc, kaolin, clay, calcium carbonate, titanium dioxide, and silica. Base papers for casting used in the present invention are those having a basis weight of 50-400 g/m$^2$ used for ordinary coated printing papers or cast-coated papers and can be selected from woodfree papers, mechanical papers, recycled papers, and the like depending on the purpose. Base papers for cast-coated papers in the present invention may be coated papers having a pre-coat layer formed-from a coating color containing a pigment and an adhesive on the base papers mentioned above. Suitable pre-coating methods can be appropriately selected from those using known coaters such as blade coaters, air knife coaters, roll coaters, spray coaters, kiss coaters, squeeze coaters, curtain coaters, bar coaters, gravure coaters, comma coaters, etc.

Pigments used in the coated layer during the casting process of cast-coated papers of the present invention can be selected for e.g., from amorphous silica, kaolin, clay, calcium carbonate, talc, alumina, aluminum hydroxide, magnesium carbonate, satin white, titanium dioxide, aluminum silicate, colloidal silica, montmorillonite, plastic pigments and the like, which can be used alone or in combination of two or more pigments.

Adhesives used in the coated layer of the present invention can be selected for e.g., from casein, soy protein and synthetic proteins, starches such as oxidized starches and esterified starches, polyvinyl alcohol, carboxymethylcellulose, hydroxycellulose, styrene/butadiene latex, acrylic emulsion, vinyl acetate emulsion, polyurethane and the like, which can be used alone or in combination of two or more adhesives.

Coating colors of the present invention can also contain various auxiliaries used in ordinary coating colors such as dispersing agents, fluidity modifiers, de-foaming agents, dyes, lubricants, water-retaining agents, dye-fixing agents, pigment dispersants, thickeners, fluidity improving agents, defoaming agents, antifoaming agents, releasing agents, foaming agents, penetrating agents, coloring dyes, coloring pigments, fluorescent whitening agents, UV absorbing agents, antioxidants, preservatives, antifungal agents, waterproof agents, wet strength agents, dry strength agents and the like.

Methods for applying a coating color onto a base paper for casting can be appropriately selected from coating methods using known coaters such as blade coaters, air knife coaters, roll coaters, comma coaters, brush coaters, kiss coaters, squeeze coaters, curtain coaters, bar coaters, gravure coaters, spray coaters and the like in the same manner as described above for pre-coating methods. The coating amount of the coated layer can be arbitrarily adjusted in the range enough to cover the surface of the base paper and to ensure sufficient ink absorption, but desirably 5-30 $g/m^2$ , especially 10-25 $g/m^2$ expressed as solids per side.

The coated layer thus formed on the base paper is pressed/dried against a casting drum having a heated mirror surface while it is in the wet state. The coated layer in the wet state can be pressed/dried against a mirror surface drum, by using the direct process involving pressing the coated layer in the undried state against a casting drum, or the gel cast coating process involving applying a coating color, then thickening the coated layer with a gelling solution and pressing it in the gel state, or the re-wet cast coating process involving applying a coating color, then once drying the coated layer and then plasticizing it with a rewetting solution and pressing it.

In the present invention, the gel cast coating process specifically comprising gelling the coated layer in the wet state with a gelling solution containing an organic acid, an oxo acid, or a metal salt of any of these acids and pressing/drying it against a mirror surface drum is advantageous over the direct process and the re-wet cast coating process in the surface quality of the cast-coated layer of the paper.

When water vapor is used for hydration according to the prior art, hydration can be achieved but water vapor can be added only from the opposite surface to the cast-coated surface because the surface quality of the cast-coated surface would be impaired if water vapor was added from the cast-coated surface. Moreover, this method is not preferable for adding much moisture because the use of a large amount of water vapor would cause condensation on surrounding pieces of equipment. However, if paper is passed through an air controlled at a high temperature and a high humidity, moisture can be added from both sides of the paper without impairing the surface quality of the cast-coated surface. Also, a larger amount of moisture can be added as compared to using water vapor because condensation can be reduced. Hydration-induced curling can also be reduced because moisture can be added from both sides.

Figure 2:
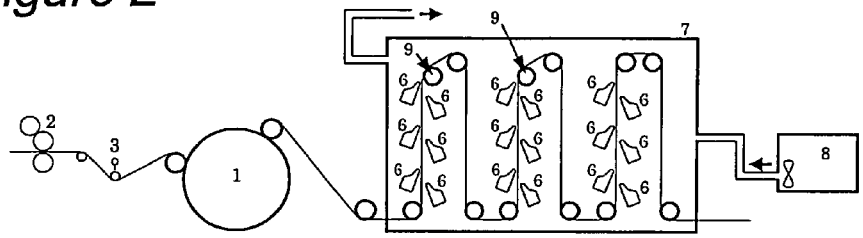
FIG. 2 is a schematic view of another example of a manufacturing apparatus of the present invention.

Equipment for hydration desirably ensure a high temperature and a high humidity around the path along which the paper passes after the cast-coated surface has been formed, and they also desirably maintain the temperature and humidity constant so as to prevent condensation or the like during the passage of the paper. In order to supply much moisture, they are desirably designed to have a relatively long path line, which requires 30 seconds or more to pass through. A possible exemplary layout is shown in FIG. 2.

As the temperature and humidity are raised, the hydration speed increases and therefore the hydration efficiency increases. However, the environment should preferably be adjusted to 40-60° C., 60-90% RH because very high temperature and humidity tend to degrade working environments and cause condensation on surrounding pieces of equipment or other related problems. The moisture content of the final product is desirably about 5.5 to 8% because the surface quality of the cast-coated surface deteriorates somewhat at a moisture content of 8% or more depending on the properties of the cast-coated surface and the quality level required.

Cast-coated papers are often coated on one-side so that they tend to readily curl when the environmental humidity is changed and after offset printing or ink jet printing has been carried out. It was found that, in order to overcome this tendency, it is effective to use a process for producing a cast-coated paper comprising the steps of pressing/drying the coated layer in the wet state against a casting drum mirror surface, wherein after pressing/drying the coated layer against a casting drum, the process further comprises the step of applying water or an aqueous solution of a starch or the like or an aqueous dispersion of a pigment or the like onto the opposite surface to the cast-coated surface and drying the paper, preferably by using a cylinder dryer having a strong confining force in the cross direction during drying, more preferably by pressing the cast-coated surface against the cylinder surface.

Methods for applying water or an aqueous solution of a starch or the like or an aqueous dispersion of a pigment or the like onto the opposite surface to the cast-coated surface after the cast-coated surface has been formed by pressing/drying the coated layer against a casting drum are not specifically limited and any device can be used so far as the aqueous liquid is evenly applied. Normally, they can be appropriately selected from coating methods using known coaters such as blade coaters, air knife coaters, roll coaters, spray coaters, kiss coaters, squeeze coaters, curtain coaters, bar coaters, gravure coaters, comma coaters and the like. Normally, it is difficult to obtain even coating profiles in cast-coated papers because the coating speed during cast coating is lower than the coating speed of ordinary coated papers. Therefore, a plurality of coaters of known coating methods can be arranged in the coating direction to attain a suitable coating amount. When water is applied to the opposite surface, the moisture content is arbitrarily selected in the range of 0.1-20 $g/m^2$, desirably 1-10 $g/m^2$ depending on the purpose and quality requirements.

Drying methods under confinement in cross direction include a cylinder dryer for drying paper while it is pressed against a heated rotating cylinder, a dryer of a type blowing hot air to paper while it is pressed against a cylinder or the like, a dryer of a type for drying paper by heating it while it is sandwiched between two belts or canvases, etc. Normally, the drying method using a casting drum is similar to the drying mechanism of cylinder dryers and has a strong confining force in the cross direction, so that both sides are evenly dried and curling can be further reduced if the opposite surface after coating treatment is also dried in a confined state in a cross direction using a cylinder dryer or the like. The moisture content of the cast-coated paper after drying is preferably 1-10% by weight, more preferably 3-8% by weight in view of the surface quality of the cast surface and curl reduction.

Cast-coated papers of the present invention can be used for various purposes including commercial printing such as the covers of magazines and posters; bags such as high-quality shopping bags and fancy packing boxes; release papers for adhesive labels; ink jet recording for ink jet printers and the like, among which they are especially useful for ink jet recording liable to curling.

EXAMPLES

The following examples and comparative examples further illustrate the present invention without, however, limiting the invention thereto as a matter of course. Unless otherwise specified, "parts" and "%" in the examples mean parts by weight and % by weight. The evaluation methods of test properties are as follows.

<Evaluation Methods>

(1) Evaluation of Curling/Waving

The cast-coated paper prepared according to each of the comparative examples and examples was cut into A4 size (297×210 mm), and 200 sheets were immediately stacked and left in an atmosphere at 23° C., 50% RH for 4 hours or more. The appearance of wavy deformation in the cut section was visually evaluated.

○: Good cut section without waving.

Δ: Relatively good cut section with some waving.

X: Significant waving,

Curling was evaluated after the paper was cut into 100 mm×100 mm and then left for 4 hours or more with the cast-coated surface upward. Curling was determined by measuring the heights of the four corners of each sample sheet laid on a flat board with the inside of the sheet curling upward. The values shown in the table represent the averages of the measurements at the four corners. Positive values correspond to curling with the cast-coated surface inward, while negative values correspond to curling with the opposite surface inward. Thus, smaller absolute values in the table mean better curling.

(2) Surface Quality of the Cast-Coated Surface

The surface quality of the cast-coated surface was visually evaluated.

○: Good reproduction of the mirror surface feature with smooth surface state.

Δ: Insufficient reproduction of the mirror surface feature with somewhat uneven gloss.

x: Insufficient reproduction of the mirror surface feature with uneven gloss.

(3) Sheet Gloss

Sheet gloss was determined at 75° C. according to JIS P 8142.

Example 1

A woodfree paper having a basis weight of 180 g/m$^2$ was used as a base paper and coated on one side with a coating color containing 121 parts of silica as a pigment, 35 parts of urethane as a binder, 10 parts of casein, and 4.7 parts of a releasing agent at a coating mass of 20 g/m$^2$ using a roll coater, and then the coating color was gelled with a gelling solution based on ammonium formate and the coating layer in the wet state was pressed against a mirror surface (casting drum) heated at 105° C. and dried to give a cast-coated layer. Then, the paper was passed through a chamber conditioned at 45° C., 75% for 60 seconds to give a cast-coated paper having a moisture content of 7% (FIG. 1).

Example 2

After a cast-coated surface was obtained in the same manner as in Example 1, the paper was passed through a chamber conditioned at 45° C., 75% RH for 60 seconds while blowing air conditioned at 45° C., 75% RH onto the cast-coated surface and the opposite surface at a wind velocity of 7 m/sec with 18 nozzles per side to give a cast-coated paper having a moisture content of 7.3% (FIG. 1).

Example 3

After a cast-coated surface was obtained in the same manner as in Example 1, the paper was passed through a chamber conditioned at 45° C., 75% RH for 60 seconds while blowing air conditioned at 45° C., 75% RH onto the cast-coated surface at a wind velocity of 5 m/sec and the opposite surface at a wind velocity of 10 m/sec with 18 nozzles per side to give a cast-coated paper having a moisture content of 7.3% (FIG. 1).

Example 4

Figure 3:
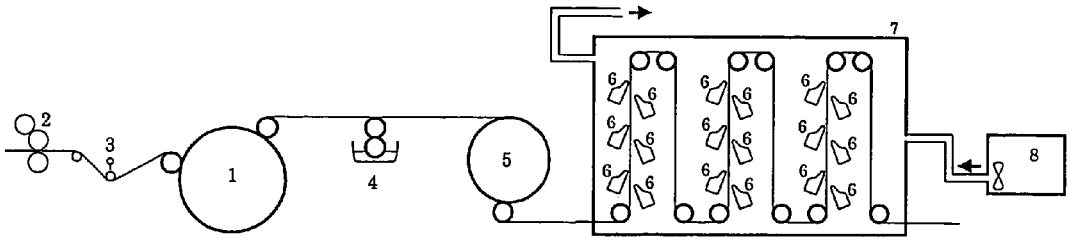
FIG. 3 is a schematic view of another example of a manufacturing apparatus of the present invention.

After a cast-coated surface was obtained in the same manner as in Example 1, 6.1 g/m$^2$ of water was applied on the opposite surface to the cast-coated surface using a roll coater and dried with a cylinder dryer, and then the paper was passed through a chamber conditioned at 45° C., 75% for 60 seconds to give a cast-coated paper having a moisture content of 7%. During drying with a cylinder dryer, the cast-coated surface was in contact with the cylinder dryer (FIG. 3).

Example 5

After a cast-coated surface was obtained in the same manner as in Example 1, the paper was passed through a chamber conditioned at 50° C., 85% RH for 60 seconds while blowing air conditioned at 50° C., 85% RH onto the cast-coated surface and the opposite surface at a wind velocity of 7 m/sec with 18 nozzles per side to give a cast-coated paper having a moisture content of 8.1%. In this example, a hydrator with expander rolls was used (FIG. 2).

Comparative Example 1

After a cast-coated surface was obtained in the same manner as in Example 1, no hydration treatment was made to give a cast-coated paper having a moisture content of 3%.

Comparative Example 2

After a cast-coated surface was obtained in the same manner as in Example 1, the paper was passed through a chamber conditioned at 45° C., 85% for 15 seconds to give a cast-coated paper having a moisture content of 4.2%.

Comparative Example 3

After a cast-coated surface was obtained in the same manner as in Example 1, the opposite surface to the cast-coated surface was subjected to steam hydration to give a cast-coated paper having a moisture content of 4.7%.

TABLE 1

| | Waving | Curling | Sheet gloss on the cast surface | Surface quality |
|---|---|---|---|---|
| Example 1 | ○ | 4 mm | 77.6 | ○ |
| Example 2 | ○ | 5 mm | 77.9 | ○ |
| Example 3 | ○ | −1 mm | 77.8 | ○ |
| Example 4 | ○ | 1 mm | 78.0 | ○ |
| Example 5 | ○ | 2 mm | 77.6 | ○ |
| Comparative example 1 | x | 20 mm | 77.1 | ○ |
| Comparative example 2 | Δ-x | 15 mm | 77.6 | ○ |

TABLE 1-continued

| | Waving | Curling | Sheet gloss on the cast surface | Surface quality |
|---|---|---|---|---|
| Comparative example 3 | Δ-x | −15 mm | 77.2 | ○ |

The evaluation results of waving in the cut section, surface quality and sheet gloss on the cast surface and curling during ink jet printing for Examples 1 to 5 and Comparative examples 1 to 3 are shown in Table 1. As apparent from the results of Table 1, the cast-coated paper obtained by the processes of the present invention show reduced waving caused by moisture absorption, higher quality in the cast surface and better suitability for ink jet recording as compared with the comparative examples.

ADVANTAGES OF THE INVENTION

According to the present invention, cast-coated papers with reduced waving or curling caused by moisture absorption after cutting and of a high quality cast-coated surface can be obtained. This advantage is especially remarkable in cast-coated papers for ink jet printing having a high affinity for water.

References in the Drawings

1 casting drum
2 coater head (coating section)
3 gelling solution applicator
4 reverse face water applicator
5 cylinder dryer
6 air nozzle
7 conditioned chamber
8 blower
9 expander roll

The invention claimed is:

1. A process for producing a cast-coated paper, comprising the steps of:

applying a coating color comprising a pigment and an adhesive on one side of a base paper, pressing/drying the coated layer in a wet state against a mirror surface of a casting drum, and adding moisture to the coated paper by maintaining both sides of the cast-coated paper in an air which is conditioned at 20-80° C., 50-95% RH for 20 seconds or more and by blowing the conditioned air directly onto the both sides of the cast-coated paper, the coated surface and the opposite surface, using a plurality of air nozzles as the paper moves along an open draw, after pressing/drying the coated layer against a casting drum and before reeling.

2. The process for producing a cast-coated paper of claim 1, wherein wrinkles are prevented by using an expander roll during the hydration of the cast-coated paper by blowing conditioned air.

3. The process for producing a cast-coated paper of claim 1, wherein said process further comprises the step of applying water or an aqueous solution or an aqueous dispersion of a pigment or the like onto the opposite surface to the cast-coated surface and drying it immediately after pressing/drying the coated layer against a casting drum and before maintaining the coated paper in the conditioned air.

4. An apparatus for producing a cast-coated paper, comprising: (1) a coater head for applying a coating color comprising a pigment and an adhesive on one side of a base paper, (2) a casting drum for pressing/drying the coated layer in a wet state against a mirror surface of a casting drum, and (3) a conditioned chamber having an inlet and an outlet for a web of cast-coated paper in this order, wherein said chamber is connected to a blower for sending conditioned air into said chamber and has a conditioned air vent, whereby said chamber is conditioned at 20° C.-80° C., 50-95% RH and both sides of said web is maintained in said chamber for 20 seconds or more, and wherein said chamber has a plurality of air nozzles for blowing the conditioned air directly onto both sides of said web as the paper moves along an open draw.

5. The apparatus for producing a cast-coated paper of claim 4, wherein an expander roll for preventing wrinkles is provided in said conditioned chamber.

6. The apparatus for producing a cast-coated paper of claim 4, comprising a water applicator for applying water or an aqueous solution or an aqueous dispersion of a pigment or the like onto the opposite surface to the cast-coated surface after said casting drum and before said conditioned chamber.

* * * * *